US007114483B2

(12) United States Patent
Lee

(10) Patent No.: US 7,114,483 B2
(45) Date of Patent: Oct. 3, 2006

(54) LUBRICATION DEVICE FOR FOUR-STROKE ENGINE

(76) Inventor: Shin-Chang Lee, 4F., No. 25, Lane 102, Jinjhu Rd., Hsinchu City (TW)

( * ) Notice: Subject to any disclaimer, the term of this patent is extended or adjusted under 35 U.S.C. 154(b) by 0 days.

(21) Appl. No.: 11/148,534

(22) Filed: Jun. 9, 2005

(65) Prior Publication Data

US 2005/0274349 A1 Dec. 15, 2005

(30) Foreign Application Priority Data

Jun. 11, 2004 (TW) ..... 93116851 A

(51) Int. Cl.
*F01M 1/00* (2006.01)

(52) U.S. Cl. ..... 123/196 R

(58) Field of Classification Search ..... 123/196 R, 123/196 W, 196 M; 184/6.2
See application file for complete search history.

(56) References Cited

U.S. PATENT DOCUMENTS 5,975,042 A * 11/1999 Aizawa et al. ..... 123/196 M
6,863,043 B1 * 3/2005 Kurihara et al. ..... 123/196 R
6,945,215 B1 * 9/2005 Kawamoto et al. .... 123/196 W

* cited by examiner

*Primary Examiner*—Stephen K. Cronin
*Assistant Examiner*—Hyder Ali

(57) ABSTRACT

Disclosed is a lubrication device for a four-stroke engine, including three independent spaces which are crank room, cam room and lubricant room. A chamber is in communication with the three spaces respectively. A suction path assembly is located in the lubricant room and a plurality of suction holes are defined in the path assembly. An air inlet is defined in the suction path assembly. When the piston moves upward, the crank room is in a negative pressure status so as to suck air via the suction path assembly which is in communication with the crank room and the lubricant room by the chamber. The air flows fast in the suction path assembly and generates lower pressure so as to suck the lubrication oil which is then moisturized and sent into the crank room. When the piston moves downward, the crank room and the cam room are in communication with each other and the lubrication oil is sent into the cam room.

16 Claims, 9 Drawing Sheets

LUBRICATION DEVICE FOR FOUR-STROKE ENGINE

FIELD OF THE INVENTION

The present invention relates to a lubrication device for a four-stroke engine, and more particularly, to a lubrication device that allows the engine to be operated at any angle while the parts of the engine is lubricated.

BACKGROUND OF THE INVENTION

Four-stroke engines generate less pollution and use less fuel than two-stroke engines do so that more and more small power tools such as mowers, trimmers, chain saws, or even remote control model engines use four-stroke engine as the power supply. These power tools are operated at different angles so that all the parts of the engines have to well lubricated when operation. A special designed lubrication device is needed to provide proper lubrication. The conventional way is to moisturize the lubrication oil so that the moisturized lubrication oil can flow to every part of the engine.

SUMMARY OF THE INVENTION

The main object of the present invention is to provide a lubrication device that functions whichever position the four-stroke engine is arranged. When the piston moves upward, the negative pressure in the crank room sucks the air above the lubrication level in the lubricant room. The air flows fast to suck the lubrication oil by the suction holes of the suction path assembly and the lubrication oil is moisturized and sent to lubricate different parts.

Another object of the present invention is to provide a lubrication device for a four-stroke engine and includes a chamber which is in communication with the crank room, the cam room and the lubricant room respectively. The chamber communicates the crank room and the lubricant room when the piston moves upward, so that the lubrication oil is sent into the crank room to lubricate the crank, the piston and the connecting rod. The lubrication oil is sent into the cam room to lubricate the cam device and the swing arm unit when the piston moves downward.

Yet another object of the present invention is to provide a recycle path which includes a loop path between the cylinder head body and the head cover. The loop path includes at least two inlets in corners of the head cover and an aperture in the top of the head cover. No matter how the engine is arranged, the lubrication oil is able to enter the loop path via the inlets or the aperture to be collected into the lubricant room.

In order to achieve these objects, the lubrication device for a four-stroke engine and includes three independent spaces which are crank room, cam room and lubricant room. A chamber is in communication with the three spaces respectively. A suction path assembly is located in the lubricant room and a plurality of suction holes are defined in the path assembly. An air inlet is defined in the suction path assembly. When the piston moves upward, the crank room is in a negative pressure status so as to suck air via the suction path assembly which is in communication with the crank room and the lubricant room by the chamber. The air flows fast in the suction path assembly and generates lower pressure so as to suck the lubrication oil which is then moisturized and sent into the crank room. When the piston moves downward, the crank room and the cam room are in communication with each other and the lubrication oil is sent into the cam room.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
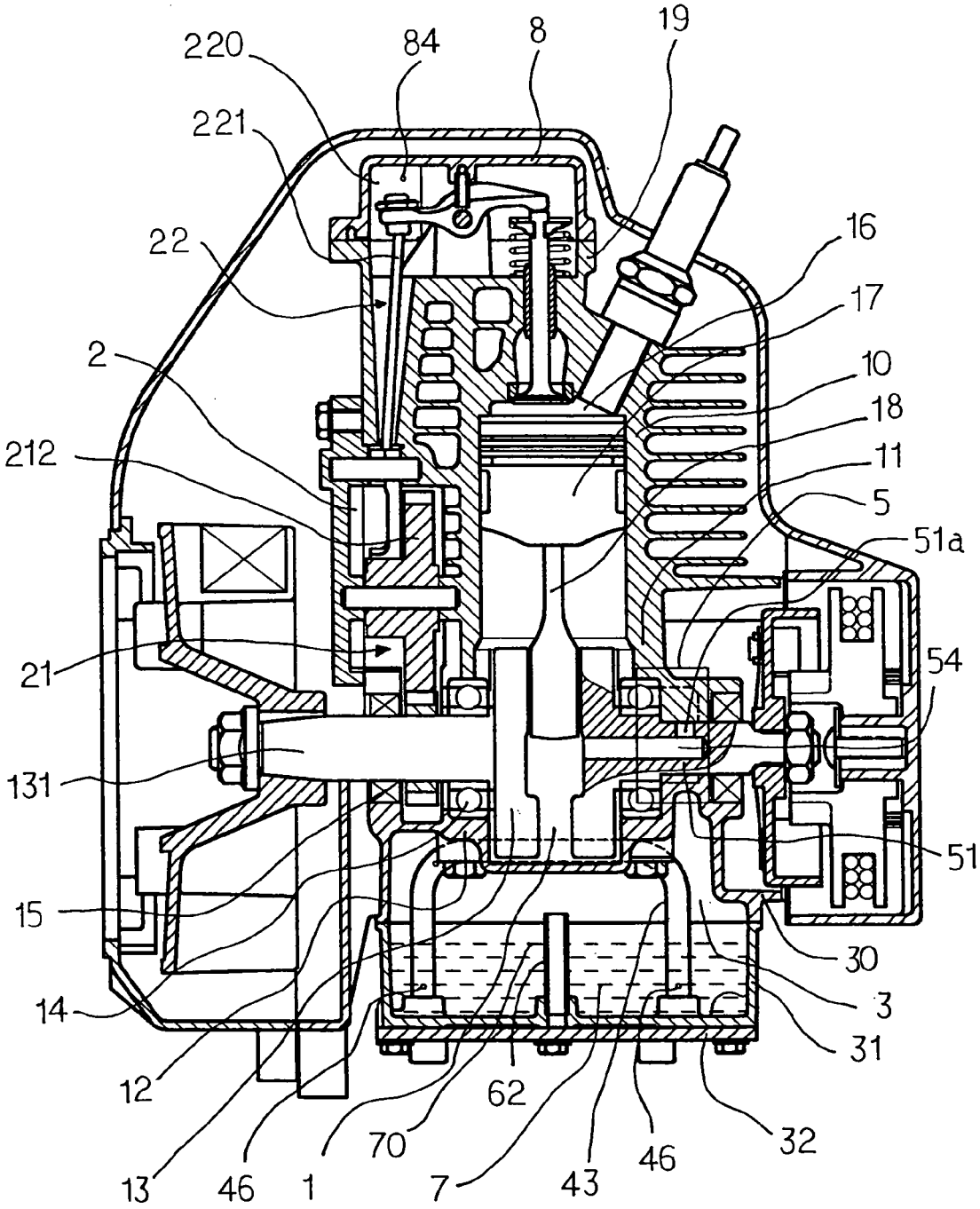
FIG. 1 shows a front cross sectional view of a lubrication device of the present invention.
Figure 2:
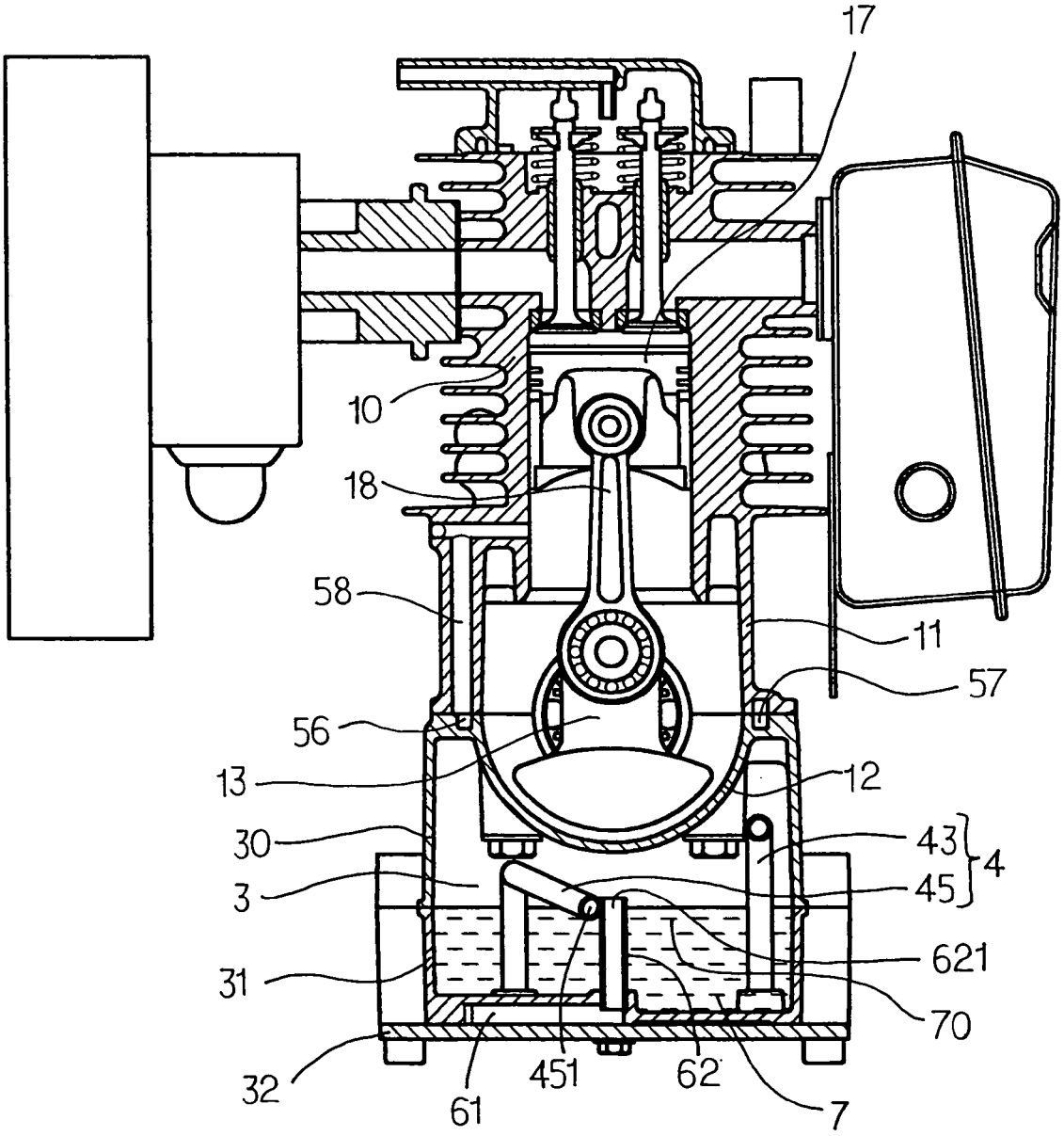
FIG. 2 shows another cross view of the lubrication device of the present invention.

It is noted that some of the drawings cited hereinafter may be exaggerated for the descriptive purposes. Referring to FIGS. 1 and 2 wherein the crank room 1 is composed of an upper casing 11 having the cylinder body 10 and a lower casing 12, the upper casing 11 is integral with the cylinder body 10 in this embodiment, two individual the upper casing 11 and the cylinder body 10 are also allowed if needed. The lower casing 12 is correspondent to the upper casing 11 and is fixed to the upper casing 11 by bolts so as to form a enclosed a crank room 1 and the crank 13 is received in the crank room 1. Bearings 14 and seals 15 are mounted to two ends of the crank 13 such that the crank 13 is rotatable in the crank room 1. A combustion camber 16 is located on a top of the cylinder body 10 and includes a piston 17 and a connecting rod 18 received therein.

Figure 3A:
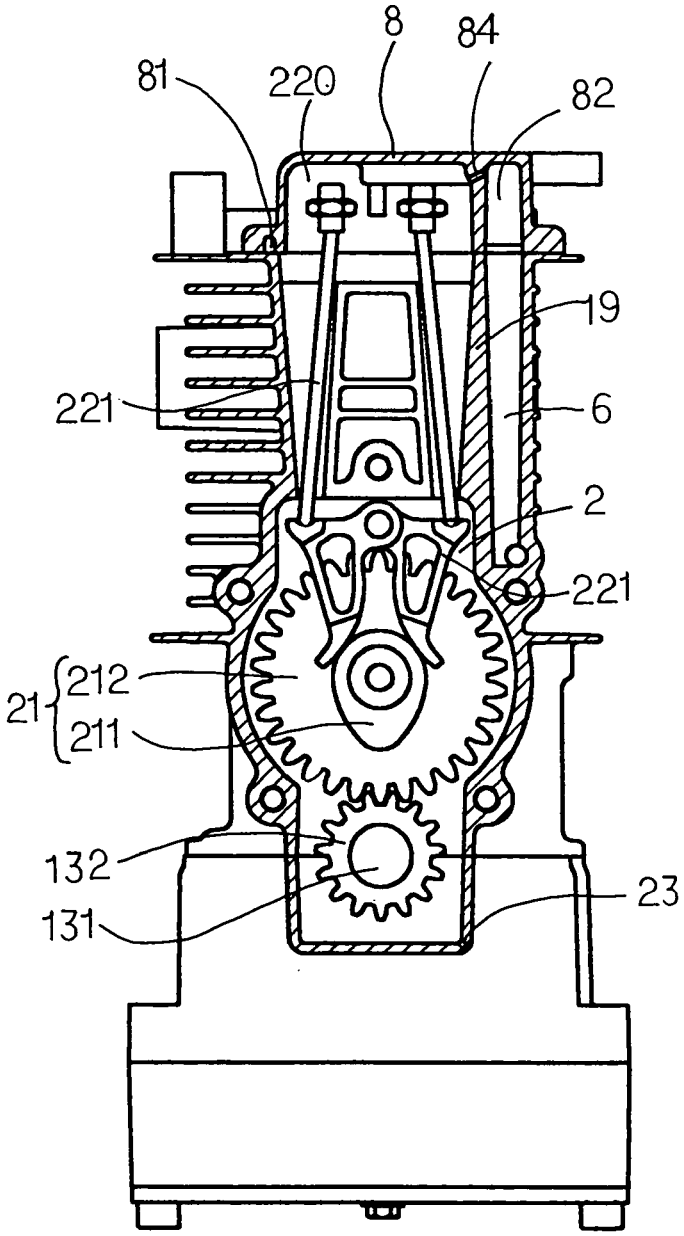
FIG. 3A shows a cross sectional view of the cam room.

The cam room 2 receives the cam device 21 and the swing arm unit 22 as shown in FIGS. 1 and 3A, the cam device 21 has a cam shaft 211, a gear 212 which is engaged with a gear 132 on the shaft 131 of the crank 13. The swing arm unit 22 includes a swing arm mechanism 221 that is connected with the cam shaft 211. The cooperation of the cam shaft 211 together with the movement of the piston 17 controls the timing of timely feeding of fuel, air in-taking and out-taking.

As shown in FIGS. 1, 2, 4A and 4B, the lubricant room 3 is an enclosed space and is composed of the lubricant tank 30 on the lower casing 12, the bottom casing 31 and the bottom board 32. The lubrication oil 7 is stored in the space and the lubricant tank 30 can be integrally formed with the lower casing 12.

The lubricant room 3 includes a suction path assembly 4 which is composed of a plurality of pipes which include a suction pipe "A" 41, a suction pipe "B" 43, a main pipe 45, and the sub-pipes 42, 44 defined by the bottom casing 31 and the bottom board 32. These pipes are in communication with each other in sequence. The main pipe 45 includes an air inlet 451 that sucks air therefrom and the airflows through the main pipe 45, the sub-pipe 44, the suction pipe "B" 43, the sub-pipe 42, and the suction pipe "A" 41. A plurality of tiny suction holes 46 is defined through each of the pipes 45, 43, 41 mentioned above so as to moisturize the lubrication oil 7. The suction pipe assembly 4 is in a negative pressure status when the parts of the engine move and the main suction pipe 45 sucks air into it and the air flows so fast in the narrow space so as to generate pressure difference to moisturize the lubrication oil 7 sucked via the suction holes 46.

Figure 4A:
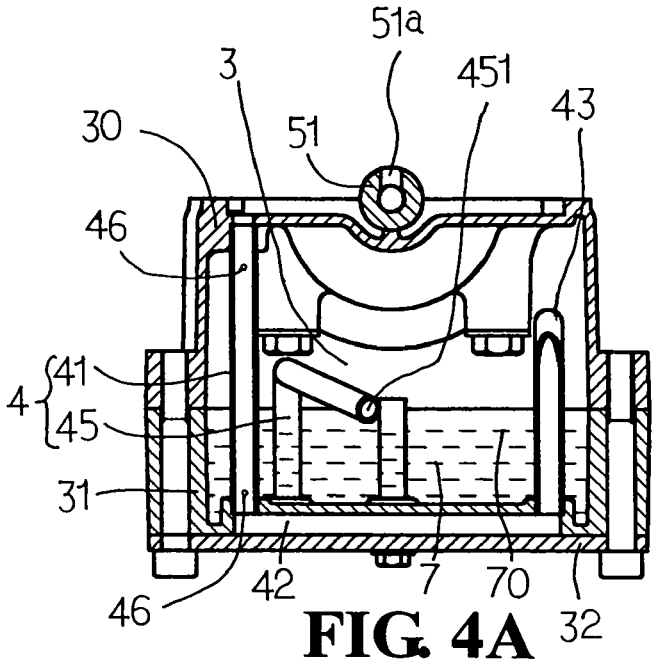
FIG. 4A shows a cross sectional view of the lubricant room.
Figure 4C:
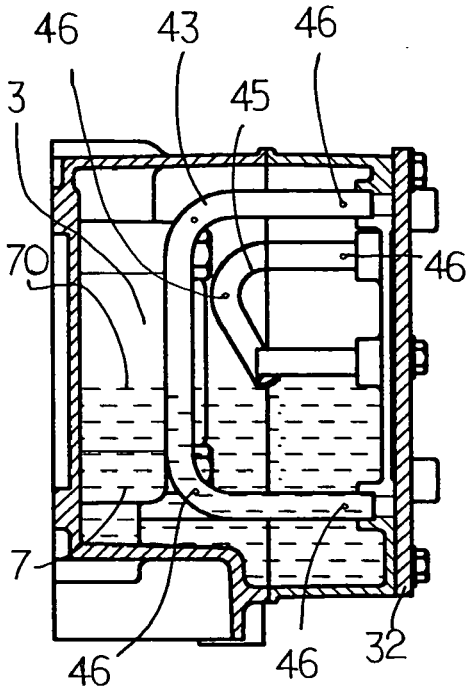
FIG. 4C shows a cross sectional view of the lubricant room when the engine is inclined.
Figure 4B:
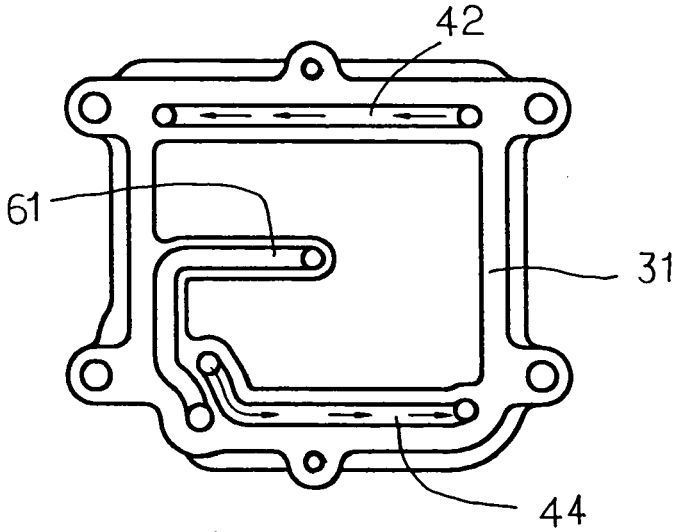
FIG. 4B shows a bottom view of the bottom casing to show the arrangement of the pipes therein.

The locations and shapes of the suction pipe assembly 4 and the number of the suction holes 46 are designed such that at least one of the suction holes 46 is merged beneath the level 70 of the lubrication oil 7 whichever position that the engine is inclined as shown in FIG. 4C. It is preferable that two or more than two suction holes 46 are merged beneath the level 70 of the lubrication oil 7. Besides, the suction pipe "A" 41, the suction pipe "B" 43, the main suction pipe 45 and the sub-pipes 42, 44 can be made to be a single pipe which is extended to every corner in the lubricant room 3 and the suction holes are defined in the pipe at each corner.

The positions of the air inlet 451 of the main pipe 45 and the amount of the lubrication oil 7 to be used are precisely calculated so that the air inlet 45 is always located above the level 70 of the lubrication oil 7 whichever positions of the engine is inclined and by this way, no lubrication oil 7 is sucked via the air inlet 45.

Figure 5A:
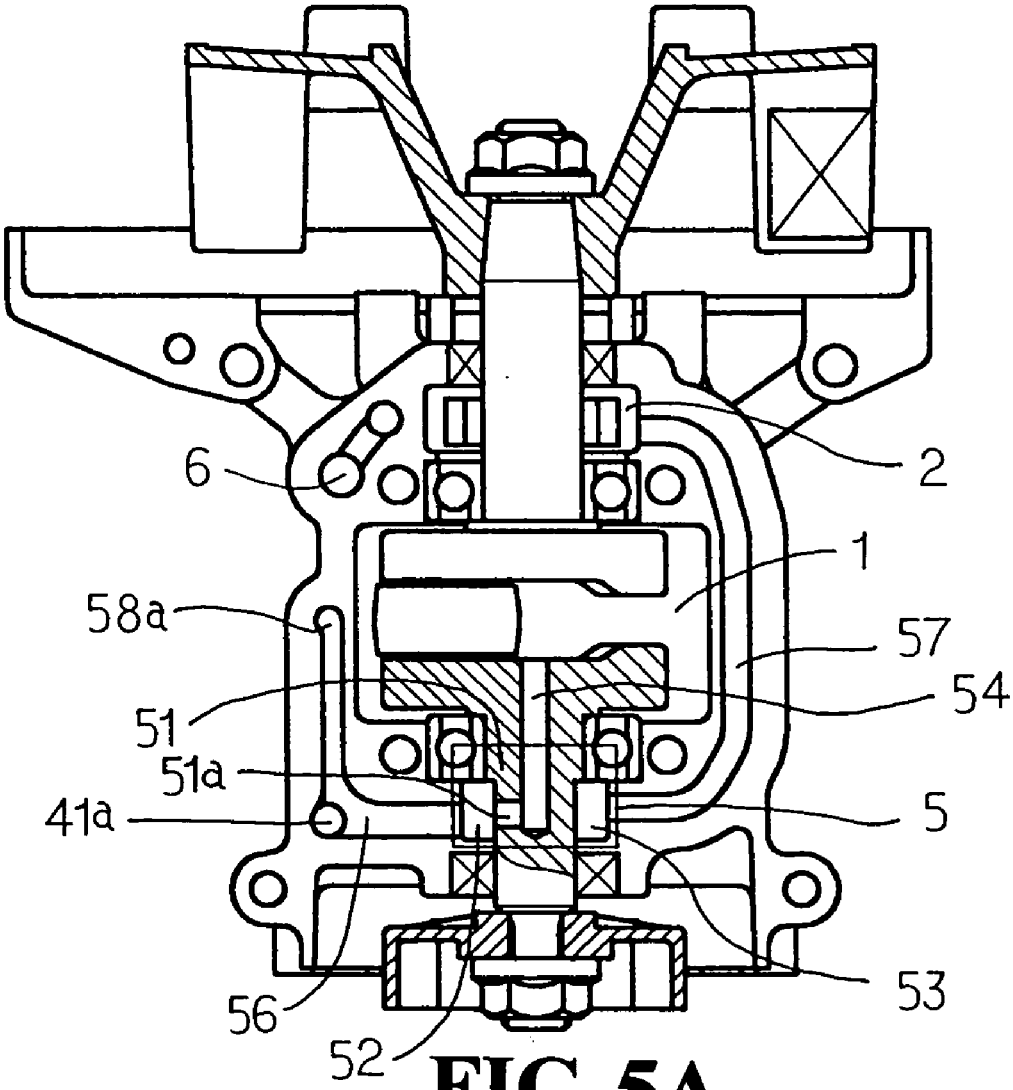
FIG. 5A shows the lower casing and the parts located nearby.
Figure 5B:
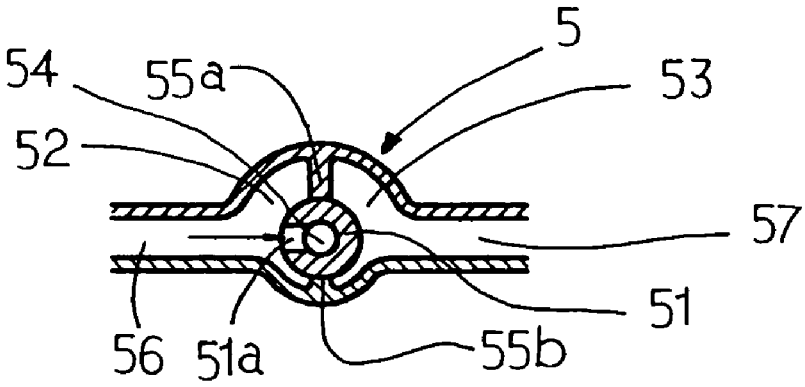
FIG. 5B shows the cross sectional view of the chamber at different angles of the crank (the piston moves upward)

As shown in FIGS. 1 and 5A and 5B, the chamber 5 is located between the upper casing 11 and the lower casing 12, and is in communication with the crank room 1, the cam room 2 and the suction pipe assembly 4 of the lubricant room 3. The chamber 5 includes a control valve 51, a suction area 52, and an outgoing area 53. The control valve 51 is a rod and connected to the shaft 131 of the crank 13 so as to be co-axially connected with the crank 13. A passage 54 is defined in the control valve 51 and communicates with the crank room 1 so as to define a through hole 51*a* in the other side of the control valve 51. The suction area 52 and the outgoing area 53 are separated by separation plates 55*a*, 55*b*. The suction area 52 has a guide passage 56 which is in communication with the outlet 41*a* of the suction pipe "A" 41. The outgoing area 53 includes a cam room passage 57 that is in communication with the cam room 2.

As shown in FIGS. 5A and 5B, when the piston 17 moves upward, the control valve 51 rotates to let the through hole 51*a* in the suction area 52. The passage 54 is in communication with the guide passage 56, so that the space in the crank room 1 becomes larger because of the upward movement of the piston 17 and a negative pressure is formed so as to suck the air in the passage 54, the guide passage 56 and the suction pipe assembly 4. The air above the level 70 is sucked by the suction pipe assembly 45 and the air being sucked flows so fast due to the negative pressure so that the lower pressure sucks the lubrication oil 7 outside the suction pipe assembly 4 and the lubrication oil 7 is immediately moisturized. The moisturized lubrication oil 7 enters the crank room 1 via the path that it is sucked so lubricate the crank 13, and the inside wall of the cylinder, the piston 17 and the connecting rod 18.

Figure 6A:
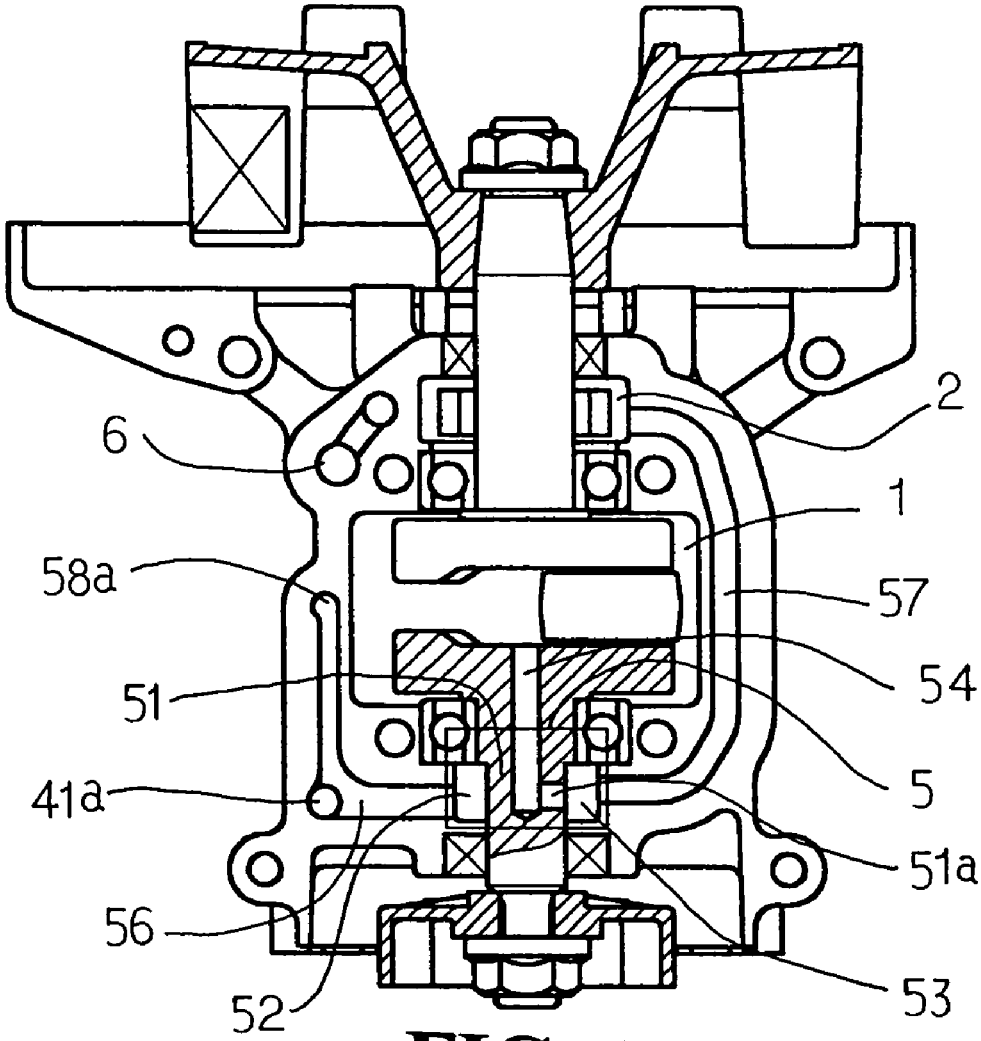
FIG. 6A shows the lower casing and the parts located nearby.
Figure 6B:
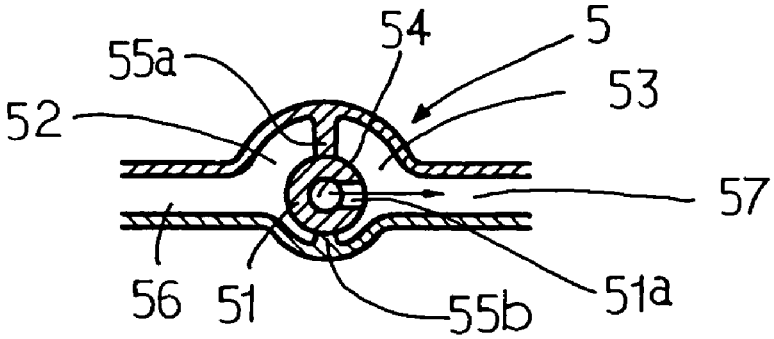
FIG. 6B shows the cross sectional view of the chamber at different angles of the crank (the piston moves downward)
Figure 7B:
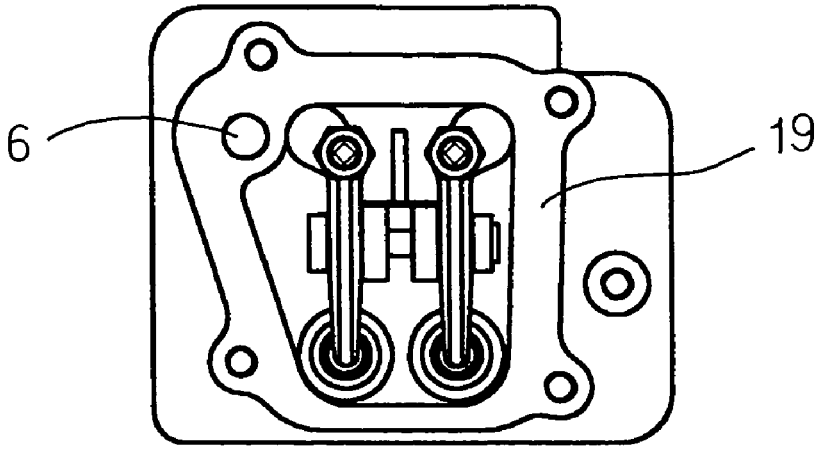
FIG. 7B is a top view of the head.
Figure 7A:
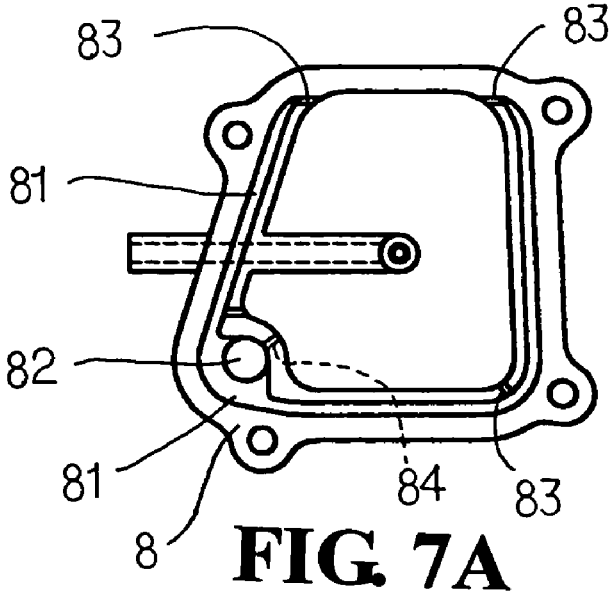
FIG. 7A is a bottom view of the head cover and shows the arrangement of the oil path.
Figure 7C:
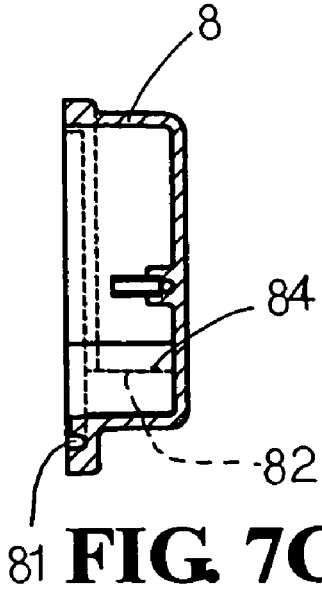
FIG. 7C is a cross sectional view of the head cover.

As shown in FIGS. 6A and 6B, when the piston 17 moves downward, the control valve 51 rotates to let the through hole 51*a* in the outgoing area 53. The passage 54 is in communication with the cam room passage 57, so that the space in the crank room 1 becomes smaller because of the downward movement of the piston 17 and a positive (high) pressure is formed so as to send the moisturized lubrication oil 7 to the cam room 2 via the passage 54 and the cam room passage 57. The cam device 21 and the swing arm unit 22 are then lubricated.

As shown in FIGS. 2 and 5A, the sucked lubrication oil 7 can also enter the crake room 1 via another passage which includes a sub-path 58 which is in communication with the lower portion of the cylinder body 10. The inlet 58*a* of the sub-path 58 communicates with the guide path 56 so that when the piston 17 moves upward, the moisturized lubrication oil is sucked into the cylinder body 10 via the guide passage 56 and the sub-path 58. This is used for lubricating special position in the cylinder body 10.

Figure 3B:
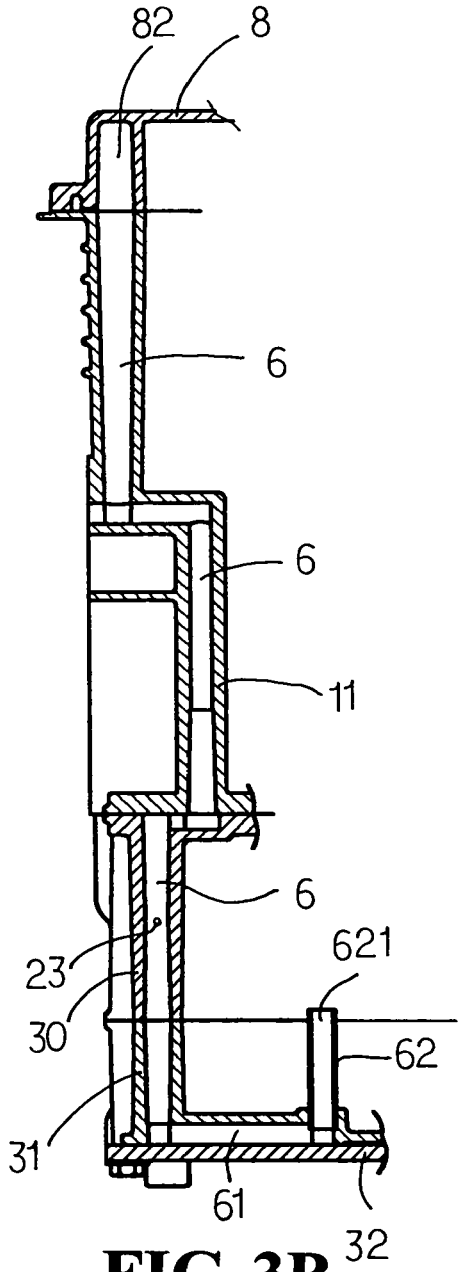
FIG. 3B the cross sectional view of the return path.

As shown in FIG. 3B, the return path 6 is located at a side of the engine body 10 and extends from a side of the swing arm room 220 to the bottom of the lubrication tank 30. The return path 6 is in communication with the return passage 61 defined between the bottom casing 31 and the bottom board 32 as shown in FIG. 2. The lubricant room 3 includes another return pipe 62 that communicates with the return path 6. The output 621 of the return pipe 62 is located close to the lubrication tank 3 and above the level 70 of the lubrication oil 7 so that the lubrication oil 7 is avoided from entering the return pipe 62.

As shown in FIGS. 3A and 3B, when the engine is used upright, the return hole 23 is defined through the bottom of the cam room 2 and communicates with the return path 6, so that the lubrication oil in liquid status flows to the return path 6 via the return hole 23 due to gravity. The negative pressure caused by the air that is located above the lubricant tank 30 and sucked by the suction path assembly sucks some of the lubrication oil via the return hole 23.

When the cylinder engine is used inclinedly, as shown in FIGS. 1, 3A, 3B, and 7A to 7C, the lubrication oil is recycled by the return path device in the swing arm room 220. The return path device is located on the conjunction surface between a cylinder head 19 and a head cover 8. The head cover 8 has a loop path 81 defined in an outside thereof and the loop path 81 has a deep inlet 82 which is in communication with the inlet of the return path 6 in the cylinder head 19. The loop path 81 has at least two inlets 83 which are in communication with the swing arm room 220. The inlets 83 are located at the four corner of the head cover 8 in this embodiment, so as to form the enclosed loop path 81 when the head cover 8 is fixed to the cylinder head 19. The inlets 83 communicates with the swing arm room 220, so that the lubrication oil can enter the return path 6 via the inlets 83 and be collected in the lubricant room 3 as long as the engine is no up-side down. An aperture 84 is defined through the head cover 8 close to the inner top and communicates with the deep inlet 82. The aperture 84 communicates with the deep inlet 82 and the swing arm room 220 so that when the engine is up side down, the lubrication oil is sucked via the aperture 84 and enters the deep inlet 82 and the loop path 81, and is collected in the lubricant room 3.

Besides that the lubrication oil can be recycled at any position of the engine, the loop path 81, the deep inlet 82, the inlet 83 are located at the connection surface of the head cover 8 so that the head cover 8 can be directly made by molding and no extra machining is needed to the head cover 8.

Figure 8A:
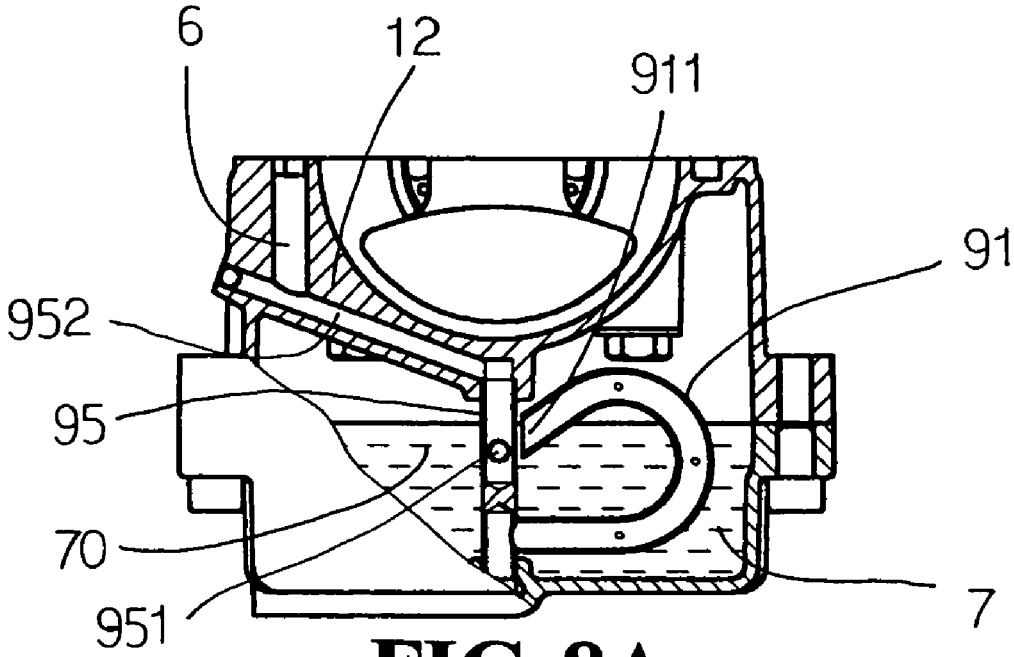
FIG. 8A is a cross sectional view of another suction path assembly in the lubricant room.
Figure 8B:
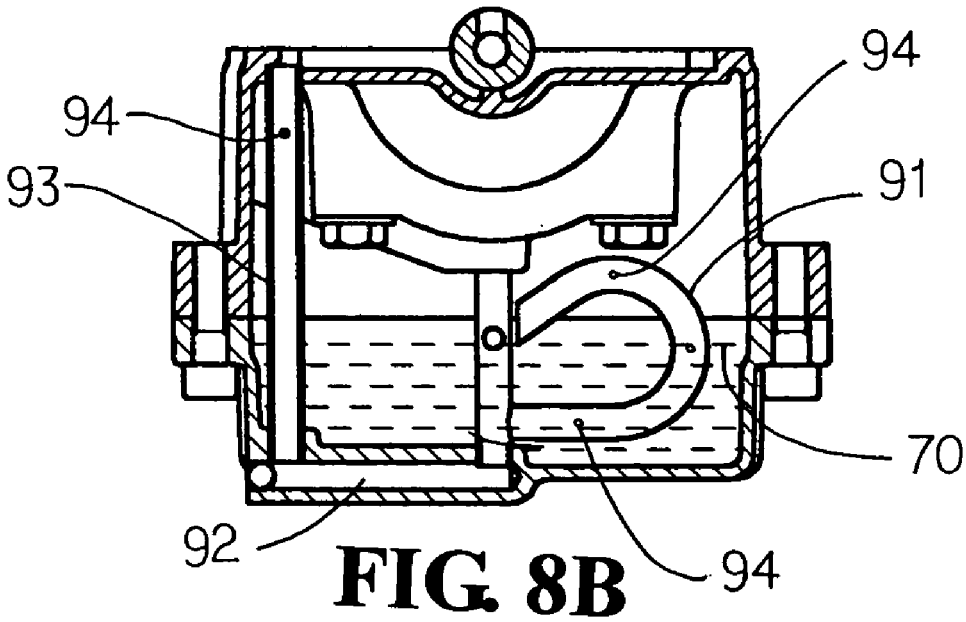
FIG. 8B is another cross sectional view of another suction path assembly in the lubricant room.

As shown in FIGS. 8A and 8B, another embodiment is disclosed and the difference is that the suction path assembly in the lubricant room. A suction pipe 9 includes a rotatable pipe 91, a pipe 92, and a moisture pipe 93, the rotatable pipe 91 is pivotably connected to a central axis of the cylinder body 10 and rotates 360 degrees due to gravity when the engine inclines at different angles. The rotatable pipe 91 has a hook portion extending from a side thereof and a plurality of suction holes 94 are defined in the hook portion, so that at least one of the suction holes 94 is merged beneath the level 70 when the rotatable pipe 91 is merged in the level 70 of the lubrication oil 7. This ensures that the lubrication function is maintained at whichever position the engine takes. The connection of the return pipe 95 and the rotatable pipe 91 share a common axis, so that the outlet 951 of the return pipe 95 is located at a middle portion and the separation in the pipe is not removed as shown in FIG. 8A. In this embodiment, the return path 6 communicates with the return pipe 952 in the bottom of the lower casing 12 so that the lubrication oil enters the lubricant room 3 via the return pipe 95.

Figure 9C:
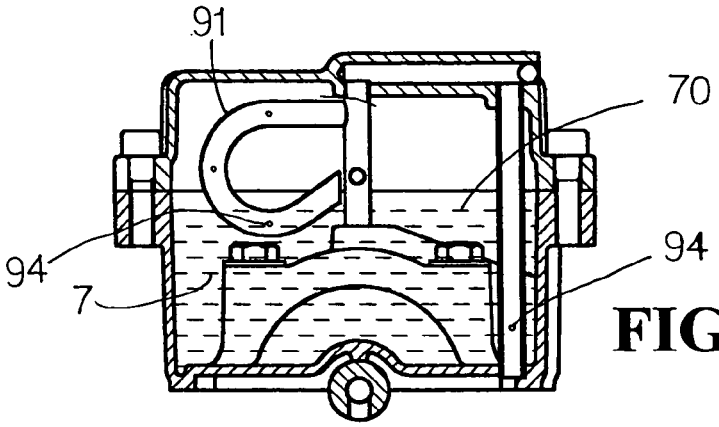
FIGS. 9A–C show that the engine is inclined at different angles.
Figure 9B:
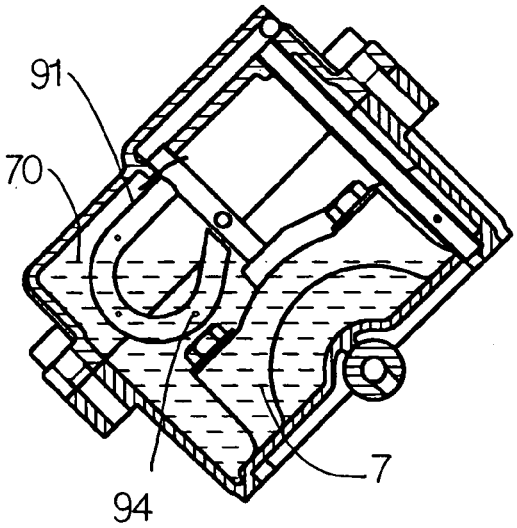
Figure 9A:
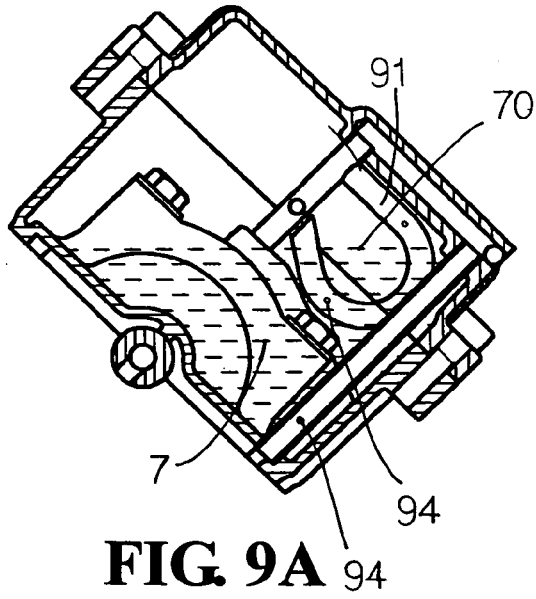

As shown in FIGS. 9A to 9C, under different angles of inclination, at least one of the suction hole 94 is merged into the level 70 of the lubrication oil 7 no matter the engine is arranged in any inclination situation. When the piston 17 moves upward and the crank room is in negative pressure, the lubrication oil 7 located outside of the suction pipe 9 is sucked via the suction hole 94 and moisturized.

While we have shown and described the embodiment in accordance with the present invention, it should be clear to those skilled in the art that further embodiments may be made without departing from the scope of the present invention.

What is claimed is:

1. A lubrication device for a four-stroke engine, comprising:

a crank room (1) communicating with a space below a piston (17), a crank (13) rotatably received in the crank room (1);

a cam room (2) in which a cam device (21) and a swing arm unit (22) are received;

an enclosed lubricant room (3) which is adapted to receive lubrication oil (7) therein and a suction path assembly (4) located in the lubricant room (3), an air inlet (451) defined in the suction path assembly (4) and located above a level (70) of the lubrication oil (7), a plurality of holes (46) defined in a wall of the suction path assembly (4) and at least one of the holes (46) located beneath the level (70) of the lubrication oil (7), and a chamber (5) respectively communicating with the crank room (1), the cam room (2) and the suction path assembly (4) of the lubricant room (3), when the piston (17) moves upward, the chamber (5) communicating with the crank room (1) and the suction path assembly (4) of the lubricant room (3), when the piston moves downward, the chamber (5) communicating with the crank room (1) and the cam room (2).

2. The lubrication device as claimed in claim 1, wherein the crank room (1) is composed of an upper casing (11) and a lower casing (12) which is fixed to the upper casing (11), the crank (13) is rotatably received between the upper casing (11) and the lower casing (12).

3. The lubrication device as claimed in claim 2, wherein the lubricant room (3) is an enclosed room and located beneath the lower casing (12), the lubricant room (3) is composed of a lubricant tank (30), bottom casing (31) and a bottom board (32), the lubricant tank (30) is integrally connected to the lower casing (12).

4. The lubrication device as claimed in claim 1, wherein the suction path assembly (4) includes a pipe which extends to each corner of the lubricant room (3) and a suction hole (46) is defined in the pipe at each corner of the lubricant room (3), the suction holes (46) are so tiny so as to suck and moisturize the lubrication oil (7) due to difference of pressure.

5. The lubrication device as claimed in claim 1, wherein the suction path assembly (4) is composed of a plurality of pipes (45) which are in communication with each other, the pipes (45) include a suction pipe "A" (41), a suction pipe "B"(43), a main suction pipe (45) and two sub-pipes (42, 44) defined by the bottom casing (31) and the bottom board (32).

6. The lubrication device as claimed in claim 5, wherein the main suction pipe (45) is the last section of the suction path assembly (4) in the lubricant room (3), the air inlet (451) of the main suction pipe (45) is located above the level (70) of the lubrication oil (7).

7. The lubrication device as claimed in claim 5, wherein the suction pipe "A" (41) and the suction pipe "B" (43) of the main suction pipe (45) are located in the lubricant room (3), a plurality of suction holes (46) are defined in the suction pipe "A" (41) and the suction pipe "B" (43), the suction holes (46) are so tiny so as to suck and moisturize the lubrication oil (7) due to difference of pressure.

8. The lubrication device as claimed in claim 1, wherein the chamber (5) is located on a side in the crank room (1) and between the upper casing (11) and the lower casing (12).

9. The lubrication device as claimed in claim 1, wherein the chamber (5) includes a control valve (51), a suction area (52) and an outgoing area (53) which is isolated from the suction area (52), the control valve (51) is a rod and connected to a shaft (131) of the crank (13) so as to be co-axially connected with the crank (13), a passage (54) is defined in the control valve (51) and communicating with the crank room (1) so as to define a through hole (51*a*) in the other side of the control valve (51), the suction area (52) has a guide passage (56) which is in communication with the suction path assembly (4) in the lubricant room (3), the outgoing area (53) includes a cam room passage (57) which is in communication with the cam room (2).

10. The lubrication device as claimed in claim 9, wherein the guide passage (56) is in communication with a sub-path (58) which has an outlet (58*a*) located in the lower portion of a cylinder body (10).

11. The lubrication device as claimed in claim 1, wherein a return path (6) is defined in a cylinder body (10) and extends from the swing arm room (220) to a bottom of the lubricant tank (30), the return path (6) is in communication with a return passage (61) defined by the bottom casing (31) and the bottom board (32).

12. The lubrication device as claimed in claim 11, wherein the lubricant room (3) includes a return pipe (62) which is in communication with the return passage (61) of the return path (6), the return pipe (62) includes an outlet which his located at a center of the lubricant room (3).

13. The lubrication device as claimed in claim 1, wherein the swing arm room (220) has an oil recycle path device which is located on the conjunction surface between a cylinder head (19) and a head cover (8), the head cover (8) has a loop path (81) defined in an underside thereof and the loop path (81) is in communication with the inlet of the return path (6), the loop path (81) has at least two inlets (83) which are in communication with the swing arm room (220).

14. The lubrication device as claimed in claim 13, wherein the loop path (81) has a deep inlet (82) which is in communication with the inlet of the return path (6) in the cylinder head (19), an aperture (84) is defined through the head cover (8) and communicates with the deep inlet (82).

15. The lubrication device as claimed in claim 1, wherein a suction pipe (9) includes a rotatable pipe (91), a pipe (92) and a moisture pipe (93), the rotatable pipe (91) is pivotably connected to a central axis of the cylinder body (10) and rotates 360 degrees due to gravity when the engine inclines at different angles, the rotatable pipe (91) has a hook portion extending from a side thereof and a plurality of suction holes (94) are defined in the hook portion.

16. The lubrication device as claimed in claim 15, wherein the lubricant room (3) include another return pipe (95) which shares a common axis with the rotatable pipe (91), an outlet (951) of the return pipe (95) is located at a middle portion and the return pipe (95), the rotatable pipe (91) and the suction pipe (9) are in communication with each other and the return pipe (95) is separated from both of the rotatable pipe (91) and the suction pipe (9), another return pipe (952) is located in the lower casing (12) and communicates with the return pipe (95) and the return path (6).

* * * * *